US010239732B2

(12) United States Patent
Park

(10) Patent No.: US 10,239,732 B2
(45) Date of Patent: Mar. 26, 2019

(54) CONVEYOR DEVICE WITH MOVING COMB PLATE IN THE LONGITUDINAL DIRECTION

(71) Applicant: Otis Elevator Company, Farmington, CT (US)

(72) Inventor: Chan-Jong Park, Vienna (AT)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/754,760

(22) PCT Filed: Aug. 26, 2015

(86) PCT No.: PCT/EP2015/069524
§ 371 (c)(1),
(2) Date: Feb. 23, 2018

(87) PCT Pub. No.: WO2017/032415
PCT Pub. Date: Mar. 2, 2017

(65) Prior Publication Data

US 2018/0237271 A1 Aug. 23, 2018

(51) Int. Cl.
*B66B 29/06* (2006.01)
*B66B 23/12* (2006.01)
*B66B 23/24* (2006.01)

(52) U.S. Cl.
CPC ..... *B66B 29/06* (2013.01); *B66B 23/12* (2013.01); *B66B 23/24* (2013.01)

(58) Field of Classification Search
CPC ..... B66B 29/02; B66B 29/06
USPC ..... 198/323, 325
See application file for complete search history.

(56) References Cited

U.S. PATENT DOCUMENTS 2,030,103 A * 2/1936 Dunlop ..... B66B 29/06 198/323
2,110,547 A 3/1938 Irving et al.
3,052,337 A 9/1962 Force, Sr.
4,476,971 A * 10/1984 Schoneweiss ..... B66B 29/06 198/323
5,255,771 A 10/1993 Nurnberg et al.
(Continued)

FOREIGN PATENT DOCUMENTS

CN 102431879 A 5/2012
DE 202009016824 U1 4/2010
(Continued)

OTHER PUBLICATIONS

International Search Report and Written Opinion for application PCT/EP2015/069524, dated Jun. 2, 2016, 12 pages.

*Primary Examiner* — James R Bidwell
(74) *Attorney, Agent, or Firm* — Cantor Colburn LLP

(57) ABSTRACT

A conveyor device includes a truss; a conveyance element, which is movable with respect to the truss in a longitudinal direction and which includes at least one groove extending along said longitudinal direction. The conveyor device further includes a comb plate having at least one tooth extending into the at least one groove. For minimizing the effects resulting from a comb crash, the conveyor device further includes at least one compensation device fixing the comb plate in the longitudinal direction during normal operation, but allowing the comb plate to move in the longitudinal direction in case of a comb crash.

11 Claims, 5 Drawing Sheets

(56) References Cited

U.S. PATENT DOCUMENTS

| | | | | |
|---|---|---|---|---|
| 5,398,800 | A * | 3/1995 | Hofling | B66B 29/06 198/323 |
| 5,611,417 | A * | 3/1997 | Stawniak | B66B 29/06 198/323 |
| 6,644,457 | B2 | 11/2003 | Lauch | |
| 9,162,851 | B2 * | 10/2015 | Quan | B66B 29/06 |
| 2003/0127301 | A1 * | 7/2003 | Lauch | B66B 29/06 198/321 |
| 2004/0134748 | A1 | 7/2004 | Tada | |

FOREIGN PATENT DOCUMENTS

| | | | |
|---|---|---|---|
| DE | 102011112528 | A1 | 3/2013 |
| EP | 2757064 | A2 | 7/2014 |
| JP | S4210989 | Y1 | 6/1967 |
| JP | H0223195 | A | 1/1990 |
| JP | 2009084013 | A | 4/2009 |
| KR | 100858783 | B1 | 9/2008 |
| SU | 814838 | A1 | 3/1981 |

* cited by examiner

CONVEYOR DEVICE WITH MOVING COMB PLATE IN THE LONGITUDINAL DIRECTION

BACKGROUND

The invention relates to a conveyor device, in particular to a conveyor device comprising at least one comb plate.

Conveyor devices for transporting passengers and/or goods are often provided in the form of escalators or moving walks extending between two landing zones. A conveyor device usually comprises a conveyance element, e.g. a chain of steps or pallets, moving into a (longitudinal) conveyance direction.

The steps or pallets are typically provided with a plurality of cleats and tread grooves extending in the longitudinal direction and arranged alternately in a direction which is oriented orthogonally to longitudinal direction. Comb plates respectively comprising a plurality of longitudinally oriented teeth, which are in a staggered relation with the cleats of the steps or pallets and extend into the tread grooves, are provided at both ends of the conveyor device.

In case of a comb crash, at least one moving step or pallet, due to its misalignment, interferes with a comb plate causing a huge force exerted by the moving conveyance element onto the comb plate. This may result in severe damage of further components of the conveyor device.

It therefore would be beneficial to provide an improved conveyor device which allows minimizing the effects of a comb crash.

SUMMARY

A conveyor device according to an exemplary embodiment of the invention comprises a truss; a conveyance element, which is movable with respect to the truss in a longitudinal conveyance direction, and which comprises at least one groove extending along said longitudinal direction. The conveyor device further comprises a comb plate having at least one tooth extending into the at least one groove, and a compensation device, which is configured for fixing the comb plate against any movement in the longitudinal direction during normal operation, but which allows the comb plate to move in the longitudinal direction in case of a comb crash.

According to an exemplary embodiment of the invention a method of reducing the damage resulting from a comb crash in a conveyor device comprising a truss; a conveyance element, which is movable with respect to the truss in a longitudinal direction and which comprises at least one groove extending along said longitudinal direction; and a comb plate comprising at least one tooth extending into the at least one groove comprises the steps of fixing the comb plate against any movement in the longitudinal direction caused by a force which is below a predetermined threshold; and allowing the comb plate to move in the longitudinal direction when the force acting on the comb plate exceeds the predetermined threshold.

Exemplary embodiments of the invention allow the comb plate to absorb the energy, which is generated in the course of a comb crash, by moving along the longitudinal direction. This may prevent severe additional damage caused by the comb crash.

In the following, exemplary embodiments of the invention will be described with reference to the enclosed figures:

DETAILED DESCRIPTION

Figure 1:
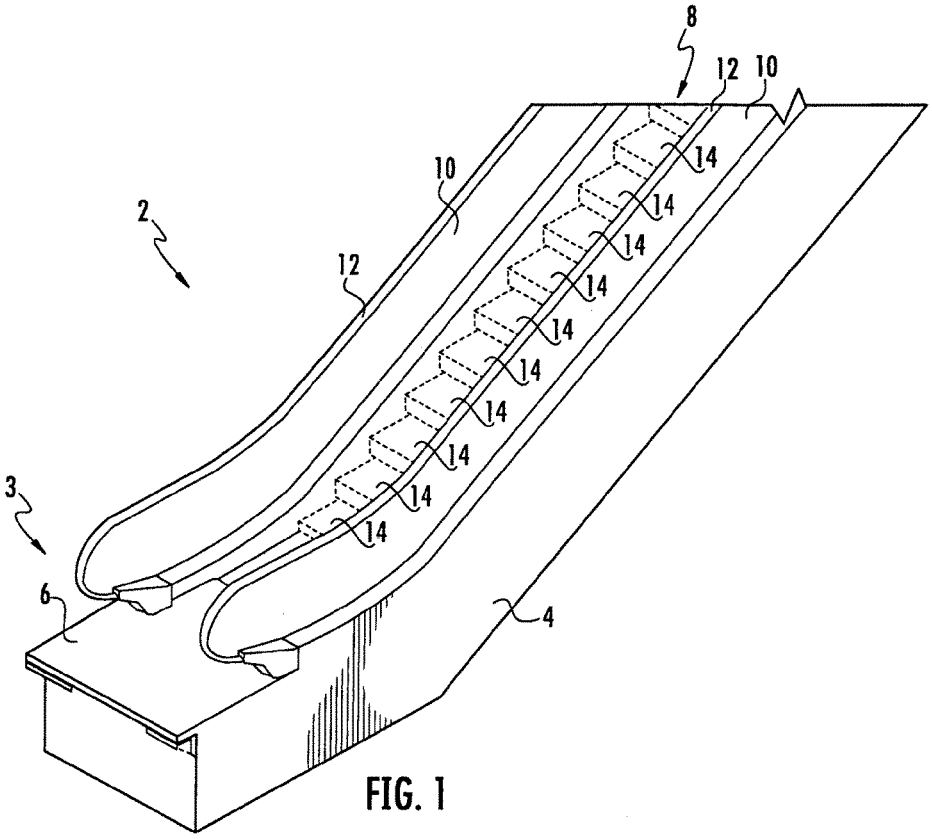
FIG. 1 shows a perspective view of a conveyor device according to an exemplary embodiment of the invention.

FIG. 1 shows a perspective view of an exemplary embodiment of a conveyor device 2, which in this example is an escalator comprising a plurality of steps 14. The ideas and principles described in the following may be applied to horizontal and inclined moving walkways comprising pallets instead of steps 14 and any other types of conveyors, as well.

The conveyor device 2 depicted in FIG. 1 extends between a lower landing zone 3 comprising a floor plate 6 and a corresponding upper landing zone, which is not shown in FIG. 1. The conveyor device 2 comprises a truss 4 extending between the lower landing zone 3 and the upper landing zone in a (longitudinal) conveyance direction.

The truss 4 supports a conveyance element 8, which in the case of an escalator is a step chain 8 comprising a plurality of steps 14, and two balustrades 10 extending parallel to the conveyance element 8. The balustrades 10 reside laterally at both sides of the conveyance element 8 respectively supporting a moving handrail 12.

Figure 2:
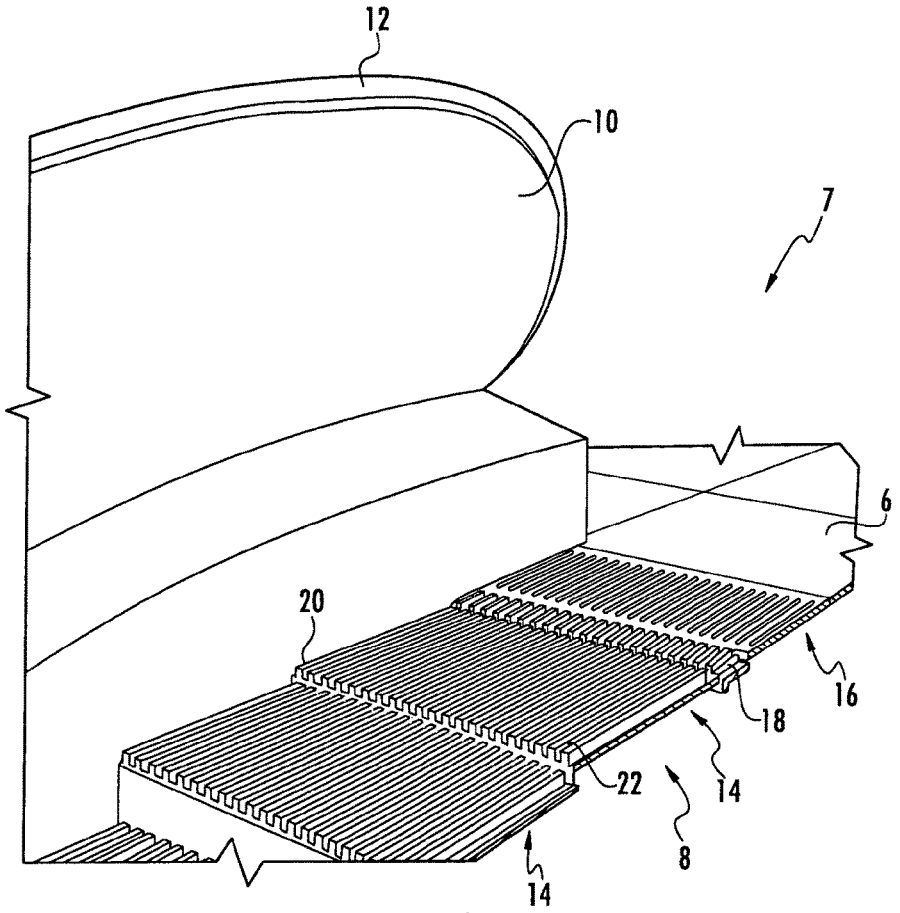
FIG. 2 shows an enlarged perspective view of an upper landing zone of a conveyor device according to an exemplary embodiment of the invention.

FIG. 2 shows an enlarged perspective view of the upper landing zone 7, which is not shown in FIG. 1.

FIG. 2 in particular illustrates that the steps 14 of the step chain 8 are provided with a plurality of alternating cleats 20 and tread grooves 22 extending in the longitudinal (conveyance) direction.

A comb plate 16 is arranged next to the floor plate 6 on the side facing the step chain 8. The comb plate 16 comprises a plurality of teeth 18 extending in the longitudinal direction. The teeth 18 are in a staggered relation with the cleats 20 of the steps 14 and extend into the tread grooves 22.

Figure 3:
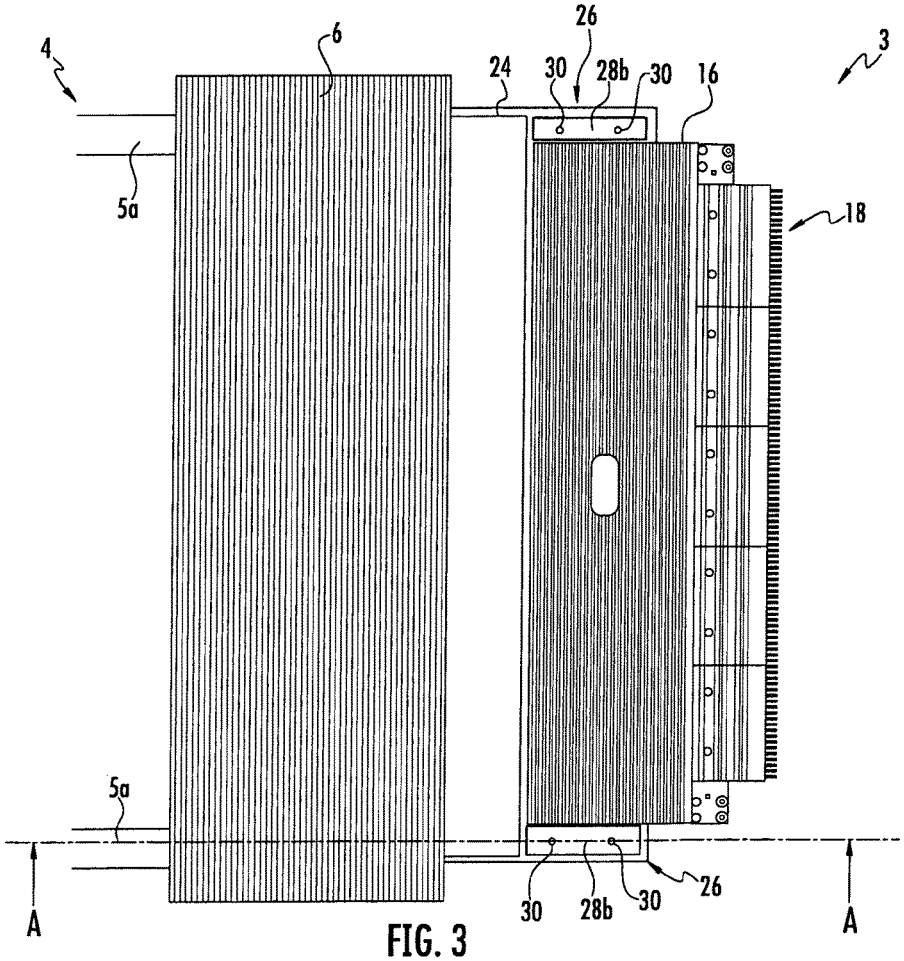
FIG. 3 shows a plane view of a lower landing zone according to an exemplary embodiment of the invention.
Figure 4:
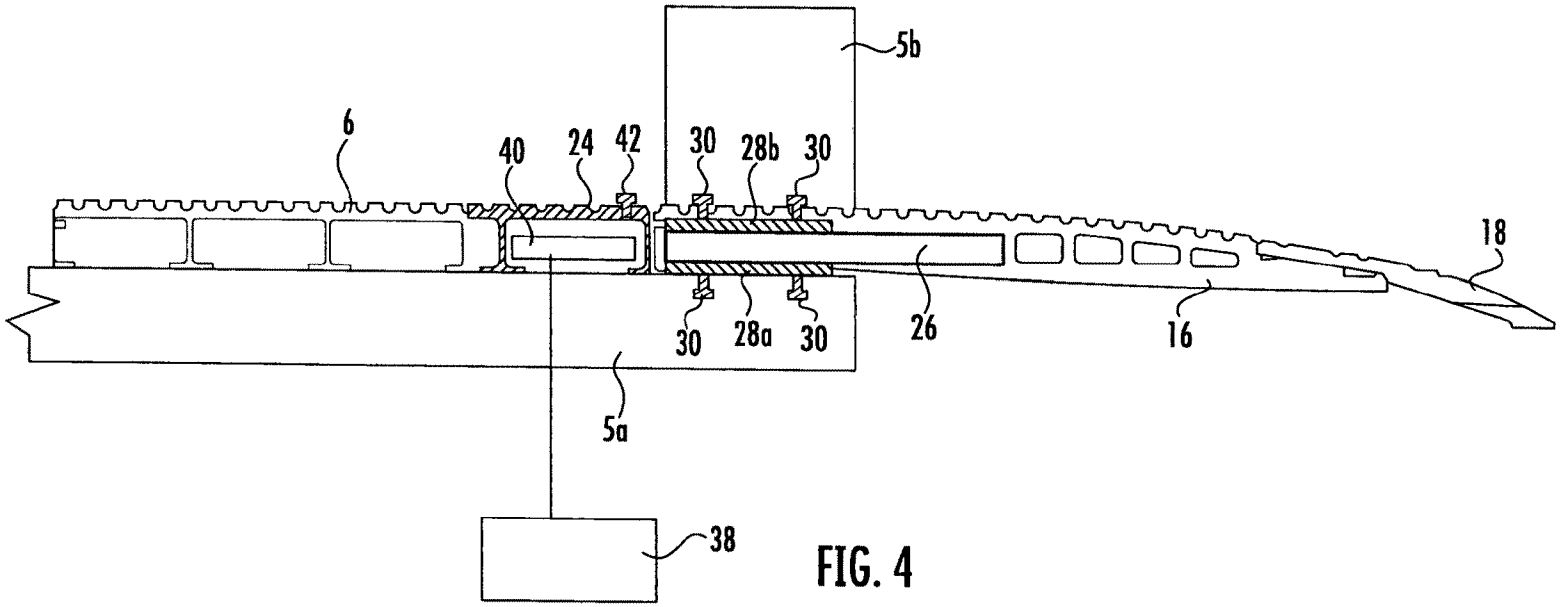
FIG. 4 shows a sectional view of the lower landing zone shown in FIG. 3.

FIG. 3 shows a plane view of the lower landing zone 3 according to an exemplary embodiment of the invention. FIG. 4 shows a sectional view of said area being cut along sectional plane A depicted in FIG. 3. Of course, the upper landing zone 7 may be formed correspondingly.

The step chain 8, which is not shown in FIGS. 3 and 4, extends to the right side of the comb plate 16 with the teeth 18 extending into the tread grooves 22 of the steps 14.

In the embodiment illustrated in FIGS. 3 and 4, a damping element 24 is arranged between the comb plate 16 and the floor plate 6 on the side of the comb plate 16 opposite to the teeth 18.

The damping element 24 is configured for allowing and damping a longitudinal movement of the comb plate 16 in case of a comb crash.

The damping element 24 in particular is elastically and/or plastically deformable in order to allow and absorb any movement of the comb plate 16 in the longitudinal direction, in particular any movement of the comb plate 16 which is caused by a comb crash.

The damping element 24, however, also has a predetermined rigidity in the longitudinal direction for preventing the comb plate 16 from moving in the longitudinal direction during normal operation of the conveyor device 2.

In a first configuration, the damping element 24 is made from a plastic material, which deforms plastically in case of a comb crash and which has to be replaced by a new damping element 24 afterwards.

In an alternative second configuration, the damping element 24 is an elastic element damping, which deforms under pressure but regains its original shape when the pressure is released. An elastic damping element 24 may be reused after a comb crash has occurred.

Such an elastic damping element 24 may be formed from an elastic material, such as rubber, and/or it may comprise at least one compressible component 40, e.g. a mechanical, pneumatic, hydraulic and/or electro-hydraulic damper for providing the desired elastic and/or energy absorption properties.

At least one of the damping element 24 and the compressible component 40 may be equipped with a sensor 42, which is configured for detecting a compression of the damping element 24 and/or the compressible component 40, respectively. In case of a comb crash resulting in a longitudinal movement of the comb plate 16, detecting the compression of the damping element 24 and/or of the compressible component 40 allows a control unit 38 to stop any further movement of the conveyance element 8 in order to avoid too much damage being caused by the comb crash.

On its side opposite to the teeth 18, the comb plate 16 is provided with lateral side portions 26 respectively extending parallel to lower longitudinal beams 5*a*, which are components of the truss 4 extending parallel to and laterally spaced apart from each other in the longitudinal direction on both sides of the truss 4.

Friction elements 28*a*, 28*b* are arranged above and below each of the lateral side portions 26, respectively. This results in a sandwich structure comprising from its bottom to its top: a lower longitudinal beam 5*a*, a lower friction element 28*a*, the lateral side portion 26, an upper friction element 28*b* and an upper beam 5*b* of the truss 4, which is not shown in FIG. 3.

The friction elements 28*a*, 28*b*, which may be provided as friction pads, are elastically supported by a couple of actuators 30. The actuators 30 are configured for exerting a vertical force onto the friction elements 28*a*, 28*b* pressing the friction elements 28*a*, 28*b* against the respective lateral side portion 26 for generating a frictional force between the friction elements 28*a*, 28*b* and the respective lateral side portion 26. The frictional force generated by the friction elements 28*a*, 28*b* is set so that it prevents the comb plate 16 from moving into the longitudinal direction during normal operation.

In case of a comb crash, however, a much bigger force is acting on the comb plate 16. The frictional force generated by the friction elements 28*a*, 28*b* is set so that said bigger force, which is generated in case of a comb crash, is sufficient to overcome the frictional force and allows the comb plate 16 to move in the longitudinal direction until the comb crash has been detected and the movement of the conveyance element 8 is stopped. Due to the inertia of the conveyance element 8 there usually is some time delay between the detection of the comb crash and the movement of the conveyance element 8 being stopped. The described retreat of the comb plate 16 reduces the forces acting on the elements of the conveyor device 2 in case of a comb crash, and in consequence the risk that additional elements will be damaged is considerably reduced. Thus, in the embodiments of the invention, a huge impact caused by a comb crash is efficiently absorbed without time delay and the movement of the conveyance element 8 may be stopped.

Figure 5:
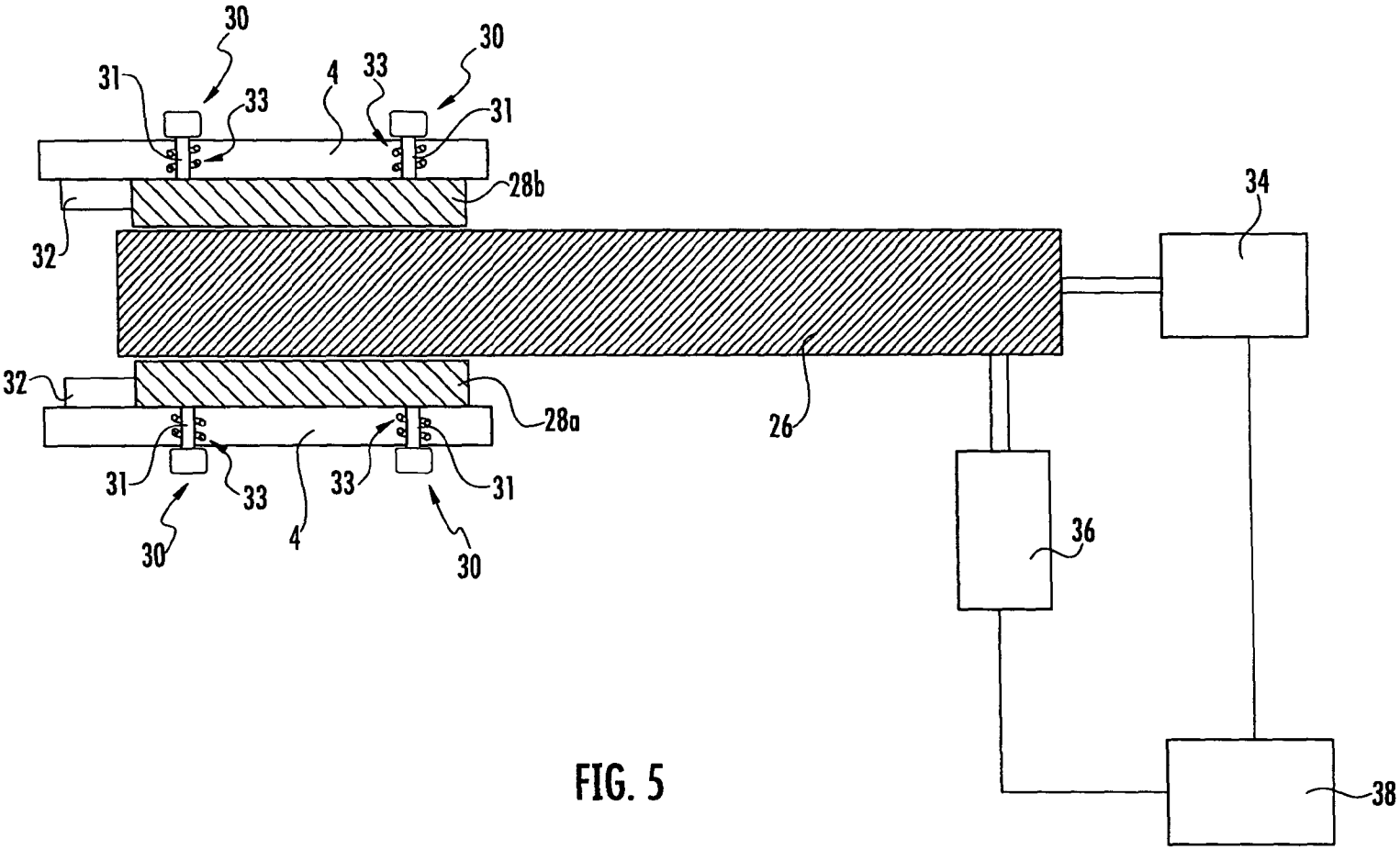
FIG. 5 shows an enlarged sectional view of a lateral side portion of the comb plate sandwiched between adjacent frictional elements.

FIG. 5 shows an enlarged sectional view of the fixture of a lateral side portion 26 of the comb plate 16 comprising an upper friction element 28*b* and a lower friction element 28*a* being pressed against the lower and upper side of the lateral side portion 26, respectively, by means of the actuators 30.

Stopper elements 32 provided next to the friction elements 28*a*, 28*b* on the side opposite to the teeth 18 of the comb plate 16 prevent the friction elements 28*a*, 28*b* from being pushed in the longitudinal direction (to the left side of FIG. 5). In consequence, in case of a comb crash, only the comb plate 16 is allowed to move in the longitudinal direction (to the left side of FIG. 5) against the frictional forces generated by the friction elements 28*a*, 28*b*, which are pressed against the lateral side portions 26 of the comb plate 16.

The frictional forces generated by the friction elements 28*a*, 28*b* may be adjusted by varying the forces exerted by the actuators 30 onto the friction elements 28*a*, 28*b*. Each of the actuators 30 e.g. may comprise a moveable bolt 31 which is pressed against the respective friction element 28*a*, 28*b* by means of an elastic element 33, e.g. a spring. In this case, the force generated by the actuator 30 may be adjusted by adjusting the strength of the elastic element 33 or by adjusting the position of the elastic element 33 with respect to the respective friction element 28*a*, 28*b* in order to change the bias of the elastic element 33. Alternatively, the elastic element 33 may be a pneumatic element. In this case, the force generated by the actuator 30 may be adjusted by varying the pressure of the air trapped inside a cavity provided within the elastic element 33.

Alternatively or additionally, the frictional forces generated by the friction elements 28*a*, 28*b* may be adjusted by adjusting the friction coefficient between the friction elements 28*a*, 28*b* and the lateral side portions 26 of the comb plate 16. This may be done be selecting an appropriate material for the friction elements 28*a*, 28*b*, in particular the material provided at the surface of the friction elements 28*a*, 28*b* facing the lateral side portions 26 of the comb plate 16.

Optionally, the surfaces of the lateral side portions 26 of the comb plate 16 facing the friction elements 28*a*, 28*b* may be treated for adjusting the friction coefficient. The surfaces of the lateral side portions 26 of the comb plate 16 facing the friction elements 28*a*, 28*b* e.g. may be roughened or coated with a material providing the desired friction coefficient. Alternatively, additional frictional pads (not shown) may be fixed to the lateral side portions 26 of the comb plate 16 facing the opposing friction elements 28*a*, 28*b* mounted to the beams 5*a*, 5*b* of the truss 4.

FIG. 5 also depicts two sensors 34, 36, which are configured for detecting a movement of a lateral side portion 26 of the comb plate 16 in the horizontal or vertical direction, respectively. When a movement of a lateral side portion 26 of the comb plate 16 is detected by at least one of the sensors 34, 36, the control unit 38 will stop the movement of the conveyance element 8 by stopping a motor driving the conveyance element 8 and/or by activating a brake.

Although in FIGS. 3 and 4 the damping element 24 is shown in combination with the frictional elements 28*a*, 28*b* this combination is only optional, i.e. the damping element 24 and the frictional elements 28*a*, 28*b* also may be implemented separately and independently from each other.

FURTHER EMBODIMENTS

A number of optional features are set out in the following. These features may be realized in particular embodiments, alone or in combination with any of the other features.

In an embodiment the conveyor device comprises at least one damping element, which is arranged next to the comb plate in the longitudinal direction. The at least one damping element is configured to prevent any movement of the comb plate in the longitudinal direction during normal operation, but it allows the comb plate to move in the longitudinal direction in case of a comb crash. The damping element may in particular be configured for absorbing the energy of the longitudinal movement of the comb plate. Accordingly, the risk of additional damage caused by a comb crash may be considerably reduced.

The damping element may be elastically and/or plastically deformable. A damping element, which is elastically deformable, may be reused after a comb crash has occurred. A damping element, which is plastically deformable, absorbs the energy, which is set free by the comb crash, very efficiently.

In an embodiment the damping element comprises a mechanical, hydraulic, pneumatic and/or electro-hydraulic compressible component providing very efficient and controllable damping properties.

In an embodiment the conveyor device comprises at least one frictional element, which is configured for fixing the comb plate in the longitudinal direction by exerting a frictional force onto the comb plate. The frictional force prevents any movement of the comb plate in the longitudinal direction during normal operation, but it allows the comb plate to move in the longitudinal direction in case of a comb crash as in this case, the force acting on the comb plate is large enough to overcome the frictional force. Accordingly, the comb plate is allowed to move in case of a comb crash and the risk of additional damage caused by a comb crash is considerably reduced.

In an embodiment the at least one frictional element is supported and pressed against the comb plate by means of at least one actuator. An actuator allows to press the at least one frictional element against the comb plate with a well defined force. The at least one actuator in particular acts in a direction which is oriented orthogonally with respect to the longitudinal direction. This ensures that the at least one frictional element is uniformly pressed against the comb plate without any inclination.

In an embodiment the at least one actuator comprises at least one elastic element which is configured for pressing the at least one frictional element against the comb plate with a well defined force. An elastic element allows an easy implementation of an actuator.

In an embodiment actuators are provided on both sides of the comb plate in the horizontal and/or in the vertical directions, respectively. Arranging two actuators above and below the comb plate provides a sandwich structure fixing the comb plate very efficiently. Arranging two actuators on both sides of the comb plate in the horizontal direction provides a symmetric fixation of the comb plate which ensures that the comb plate will move only in the horizontal direction without any rotation.

In an embodiment the conveyor device further comprises at least one sensor, which is configured for detecting any movement of the comb plate.

By detecting a movement of the comb plate, a comb crash may be detected and the movement of the conveyance element may be stopped for minimizing the damage caused by the comb crash.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention is not limited to the particular embodiment disclosed, but that the invention includes all embodiments falling within the scope of the dependent claims.

REFERENCES

2 conveyor device
3 lower landing zone
4 truss
5*a* (lower) longitudinal beams
5*b* upper beam
6 floor plate
7 upper landing zone
8 conveyance element/step chain
10 balustrade
12 handrail
14 step
16 comb plate
18 teeth of the comb plate
20 cleats
22 grooves
24 damping element
26 lateral side portion of the comb plate
28*a*, 28*b* friction elements
30 actuator
31 bolt
32 stopper element
33 elastic element
34, 36 sensors
38 control unit
40 compressible component
42 sensor

The invention claimed is:

1. Conveyor device comprising:
a truss;
a conveyance element, which is movable with respect to the truss in a longitudinal direction and which comprises at least one groove extending along said longitudinal direction;
a comb plate comprising at least one tooth extending into the at least one groove; and
at least one compensation device, which is configured for fixing the comb plate in the longitudinal direction during normal operation, and
allowing the comb plate to move in the longitudinal direction in case of a comb crash;
wherein the at least one compensation device comprises at least one damping element arranged next to the comb plate in the longitudinal direction and comprising a hydraulic, pneumatic and/or electro-hydraulic compressible component.

2. Conveyor device of claim 1, further comprising at least one sensor, which is configured for detecting any movement of the comb plate.

3. Conveyor device of claim 1, wherein the damping element is elastically and/or plastically deformable.

4. Conveyor device comprising:
a truss;
a conveyance element, which is movable with respect to the truss in a longitudinal direction and which comprises at least one groove extending along said longitudinal direction;

a comb plate comprising at least one tooth extending into the at least one groove; and at least one compensation device, which is configured for fixing the comb plate in the longitudinal direction during normal operation, and allowing the comb plate to move in the longitudinal direction in case of a comb crash;

wherein the at least one compensation device comprises at least one friction element, which is configured for fixing the comb plate in the longitudinal direction by exerting a frictional force onto the comb plate;

and at least one actuator, which is configured for pressing at least one friction element against the comb plate.

5. Conveyor device of claim 4, wherein the at least one actuator acts in a direction which is oriented orthogonally with respect to the longitudinal direction.

6. Conveyor device of claim 4, wherein the at least one actuator comprises at least one elastic element.

7. Conveyor device of claim 4, wherein friction elements are provided on both sides of the comb plate in the horizontal and/or in the vertical directions, respectively.

8. Conveyor device of claim 4, further comprising at least one sensor, which is configured for detecting any movement of the comb plate.

9. Method of reducing the damage resulting from a comb crash in a conveyor device comprising:

a truss;

a conveyance element, which is movable with respect to the truss in a longitudinal direction and which comprises at least one groove extending along said longitudinal direction; and a comb plate comprising at least one tooth extending into the at least one groove;

wherein the method comprises:

fixing the comb plate against any movement in the longitudinal direction caused by a force below a predetermined threshold;

allowing the comb plate to move in the longitudinal direction when the force acting the comb plate exceeds the predetermined threshold;

wherein the step of fixing the comb plate includes exerting a frictional force on the comb plate;

wherein exerting a frictional force on the comb plate includes pressing at least one friction element against the comb plate.

10. Method of claim 9, wherein the step of allowing the comb plate to move includes compressing a damping element, which is arranged next to the comb plate in the longitudinal direction.

11. Method of any of claim 9 further including detecting any movement of the comb plate; and stopping any movement of the conveyance element as soon as a movement of the comb plate has been detected.

* * * * *